US012582893B2

(12) United States Patent
Hu et al.

(10) Patent No.: US 12,582,893 B2
(45) Date of Patent: Mar. 24, 2026

(54) TEAM SPORTS VISION TRAINING SYSTEM BASED ON EXTENDED REALITY, VOICE INTERACTION AND ACTION RECOGNITION, AND METHOD THEREOF

(71) Applicant: NeuinX CO., LTD., Kaohsiung City (TW)

(72) Inventors: Min-Chun Hu, Hsinchu (TW); Hung-Kuo Chu, Hsinchu (TW); Pin-Xuan Liu, Hsinchu (TW); Tse-Yu Pan, Hsinchu (TW); Hsin-Shih Lin, Tainan City (TW)

(73) Assignee: NeuinX CO., LTD., Kaohsiung City (TW)

( * ) Notice: Subject to any disclaimer, the term of this patent is extended or adjusted under 35 U.S.C. 154(b) by 413 days.

(21) Appl. No.: 18/196,175

(22) Filed: May 11, 2023

(65) Prior Publication Data

US 2024/0017151 A1 Jan. 18, 2024

(30) Foreign Application Priority Data

Jul. 12, 2022 (TW) ..... 111126165

(51) Int. Cl.
*A63B 71/06* (2006.01)
*A63B 24/00* (2006.01)
*A63B 69/00* (2006.01)

(52) U.S. Cl.
CPC ..... *A63B 71/0622* (2013.01); *A63B 24/0006* (2013.01); *A63B 24/0062* (2013.01); (Continued)

(58) Field of Classification Search
None
See application file for complete search history.

(56) References Cited

U.S. PATENT DOCUMENTS

2017/0039881 A1* 2/2017 Belch ..... G11B 27/105
2017/0046967 A1* 2/2017 Sundquist ..... A63B 69/00
(Continued)

FOREIGN PATENT DOCUMENTS

CN 109091837 A 12/2018
TW I631975 B 8/2018
(Continued)

OTHER PUBLICATIONS

Pin-Xuan Liu et al., "BetterSight: Immersive Vision Training for Basketball Players", the 30th ACM International Conference on Multimedia, dated on Oct. 10-14, 2022, On-site Demonstration, Portugal.

(Continued)

*Primary Examiner* — Jason T Yen
(74) *Attorney, Agent, or Firm* — CKC & Partners Co., LLC

(57) ABSTRACT

A team sports vision training system based on extended reality, voice interaction and action recognition is configured to train vision and an action of a user. A head-mounted display device includes a task scenario player and a speech sensing module. An action capture device generates an action message. A computing server stores a scenario setting parameter group and includes a task scenario generating module, a speech recognition module and an action recognition module. The task scenario generating module generates a virtual task scenario image and a task parameter group according to the scenario setting parameter group. The speech recognition module generates a speech recognition result and a vision training result. Then action recognition module generates an action recognition result and a sport training result. The vision training result and the sport training result are configured to judge whether the user meets a training requirement.

16 Claims, 10 Drawing Sheets

(52) U.S. Cl.
CPC .. *A63B 69/0071* (2013.01); *A63B 2071/0638* (2013.01); *A63B 2071/0666* (2013.01); *A63B 2071/068* (2013.01); *A63B 2220/806* (2013.01); *A63B 2220/836* (2013.01)

(56) References Cited

U.S. PATENT DOCUMENTS

| | | | | |
|---|---|---|---|---|
| 2017/0291068 | A1* | 10/2017 | Curley | G06Q 10/1093 |
| 2018/0099201 | A1 | 4/2018 | Marty et al. | |
| 2018/0339215 | A1* | 11/2018 | Hu | G09B 19/0038 |
| 2019/0126125 | A1 | 5/2019 | Kudirka et al. | |
| 2019/0235833 | A1* | 8/2019 | Xie | G06T 19/006 |
| 2021/0097285 | A1* | 4/2021 | Lee | G06F 3/011 |
| 2022/0054927 | A1* | 2/2022 | Theriault | A63B 71/0622 |
| 2022/0138999 | A1* | 5/2022 | Isogawa | G06T 11/00 345/633 |

FOREIGN PATENT DOCUMENTS

| | | | |
|---|---|---|---|
| TW | I739551 | B | 9/2021 |
| TW | I760044 | B | 4/2022 |
| TW | I762369 | B | 4/2022 |

OTHER PUBLICATIONS

Pin-Xuan Liu et al., "An Exploratory Investigation into the Design of a Basketball Immersive Vision Training System", the 30th IEEE Conference on Virtual Reality and 3D User Interfaces, dated on Mar. 25-29, 2023, Poster Presentation, China, P.R.C.

* cited by examiner

TEAM SPORTS VISION TRAINING SYSTEM BASED ON EXTENDED REALITY, VOICE INTERACTION AND ACTION RECOGNITION, AND METHOD THEREOF

RELATED APPLICATIONS

This application claims priority to Taiwan Application Serial Number 111126165, filed Jul. 12, 2022, which is herein incorporated by reference.

BACKGROUND

Technical Field

The present disclosure relates to a team sports vision training system and a method thereof. More particularly, the present disclosure relates to a team sports vision training system based on extended reality, voice interaction and action recognition and a method thereof.

Description of Related Art

Athlete training includes different aspects, such as skills, reactions, tactics, cognitive psychology, etc. Team competitive ball sports (e.g., basketball or football) particularly emphasize tactics and cooperation between teammates.

For example, when the team sport is basketball, the player needs to pay attention not only to the ball, but also to grasp every movement of other nine players on a court. However, most players often only focus on close-range teammate(s) or defensive player(s) on the near side when they hold the ball and have defensive player(s), thus ignoring another teammate who is available on the far side or another defensive player who ambushes on the far side. Accordingly, it causes the originally planned tactics to fail to execute smoothly or even lead to mistakes.

Therefore, a team sports vision training system based on extended reality, voice interaction and action recognition and a method thereof which are capable of effectively assisting the athlete in conducting vision training are commercially desirable.

SUMMARY

According to one aspect of the present disclosure, a team sports vision training system based on extended reality, voice interaction and action recognition is configured to train vision and an action of a user and includes a head-mounted display device, an action capture device and a computing server. The head-mounted display device is disposed on the user and includes a task scenario player and a speech sensing module. The task scenario player shows a virtual task scenario image. The speech sensing module senses a speech signal of the user to generate a speech message. The action capture device captures the action of the user to generate an action message. The computing server is signally connected to the head-mounted display device and the action capture device. The computing server stores a scenario setting parameter group and receives the action message and the speech message, and the computing server includes a task scenario generating module, a speech recognition module and an action recognition module. The task scenario generating module generates the virtual task scenario image and a task parameter group according to the scenario setting parameter group, and transmits the virtual task scenario image to the head-mounted display device for the user to watch and then generate the speech signal and the action. The speech recognition module receives the speech message and recognizes the speech message according to a speech recognition procedure to generate a speech recognition result. The speech recognition module judges the task parameter group of the task scenario generating module and the speech recognition result to generate a vision training result. The action recognition module receives the action message and recognizes the action message according to an action recognition procedure to generate an action recognition result. The action recognition module judges the scenario setting parameter group and the action recognition result to generate a sport training result. The vision training result and the sport training result are configured to judge whether the user meets a training requirement.

According to another aspect of the present disclosure, a team sports vision training method based on extended reality, voice interaction and action recognition is configured to train vision and an action of a user and includes performing a virtual task scenario showing step, a speech recognizing step and an action recognizing step. The virtual task scenario showing step includes disposing a head-mounted display device on the user, configuring a task scenario generating module of a computing server to generate a virtual task scenario image and a task parameter group according to a scenario setting parameter group and transmit the virtual task scenario image to the head-mounted display device, and then configuring a task scenario player of the head-mounted display device to show the virtual task scenario image for the user to watch and then generate a speech signal and the action. The speech recognizing step includes configuring a speech sensing module of the head-mounted display device to sense a speech signal of the user to generate a speech message, and then configuring a speech recognition module of the computing server to receive the speech message and recognize the speech message according to a speech recognition procedure to generate a speech recognition result, and judge the task parameter group of the task scenario generating module and the speech recognition result to generate a vision training result. The action recognizing step includes configuring an action capture device to capture the action of the user to generate an action message, and then configuring an action recognition module of the computing server to receive the action message and recognize the action message according to an action recognition procedure to generate an action recognition result, and judge the scenario setting parameter group and the action recognition result to generate a sport training result. The vision training result and the sport training result are configured to judge whether the user meets a training requirement.

BRIEF DESCRIPTION OF THE DRAWINGS

The present disclosure can be more fully understood by reading the following detailed description of the embodiment, with reference made to the accompanying drawings as follows.

DETAILED DESCRIPTION

The embodiment will be described with the drawings. For clarity, some practical details will be described below. However, it should be noted that the present disclosure should not be limited by the practical details, that is, in some embodiment, the practical details is unnecessary. In addition, for simplifying the drawings, some conventional structures and elements will be simply illustrated, and repeated elements may be represented by the same labels.

It will be understood that when an element (or device, module) is referred to as be "connected to" another element, it can be directly connected to the other element, or it can be indirectly connected to the other element, that is, intervening elements may be present. In contrast, when an element is referred to as be "directly connected to" another element, there are no intervening elements present. In addition, the terms first, second, third, etc. are used herein to describe various elements or components, these elements or components should not be limited by these terms. Consequently, a first element or component discussed below could be termed a second element or component.

Figure 1:
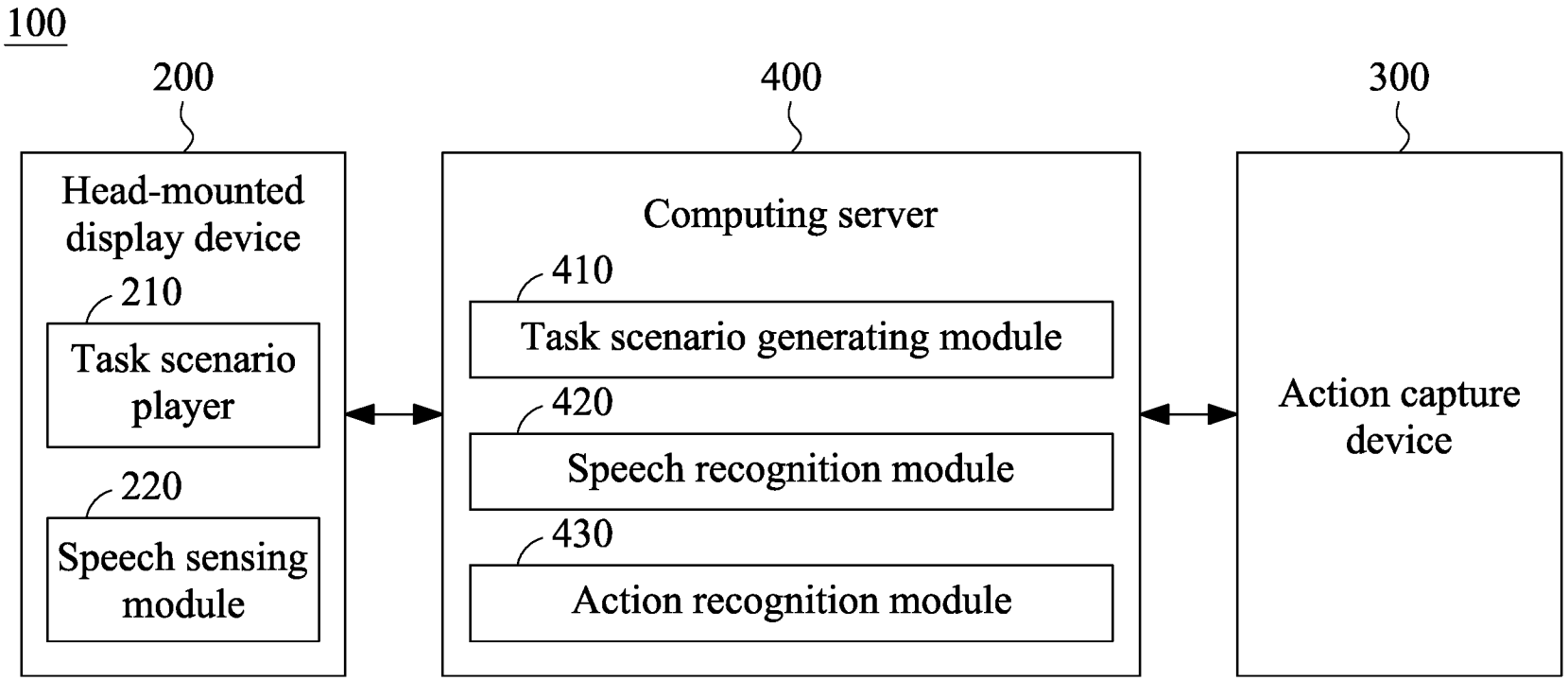
FIG. 1 shows a block diagram of a team sports vision training system based on extended reality, voice interaction and action recognition according to a first embodiment of the present disclosure.

Reference is made to FIG. 1. FIG. 1 shows a block diagram of a team sports vision training system 100 based on extended reality, voice interaction and action recognition according to a first embodiment of the present disclosure. The team sports vision training system 100 based on extended reality, voice interaction and action recognition is configured to train vision and an action of a user and includes a head-mounted display device 200, an action capture device 300 and a computing server 400. The head-mounted display device 200 is disposed on the user and includes a task scenario player 210 and a speech sensing module 220. The task scenario player 210 shows a virtual task scenario image. The speech sensing module 220 senses a speech signal of the user to generate a speech message. The action capture device 300 captures the action of the user to generate an action message. In addition, the computing server 400 is signally connected to the head-mounted display device 200 and the action capture device 300. The computing server 400 stores a scenario setting parameter group and receives the action message and the speech message, and the computing server 400 includes a task scenario generating module 410, a speech recognition module 420 and an action recognition module 430. The task scenario generating module 410 generates the virtual task scenario image and a task parameter group according to the scenario setting parameter group, and transmits the virtual task scenario image to the head-mounted display device 200 for the user to watch and then generate the speech signal and the action. The speech recognition module 420 receives the speech message and recognizes the speech message according to a speech recognition procedure to generate a speech recognition result. The speech recognition module 420 judges the task parameter group of the task scenario generating module 410 and the speech recognition result to generate a vision training result. The action recognition module 430 receives the action message and recognizes the action message according to an action recognition procedure to generate an action recognition result. The action recognition module 430 judges the scenario setting parameter group and the action recognition result to generate a sport training result. The vision training result and the sport training result are configured to judge whether the user meets a training requirement. Therefore, the team sports vision training system 100 based on extended reality, voice interaction and action recognition of the present disclosure utilizes an extended reality helmet combined with voice interaction and action recognition technologies to be capable of effectively assisting the user (e.g., athletes or players) in conducting vision training, and making it easier for the user to grasp the movements of teammates on an ever-changing court, and then helping the team score and win. In addition, the present disclosure can realize individual training to avoid the problem of high manpower costs in training due to the need for repeated practice by multiple people on the physical court in a conventional technique. The following is a detailed description of the above-mentioned devices.

Figure 2:
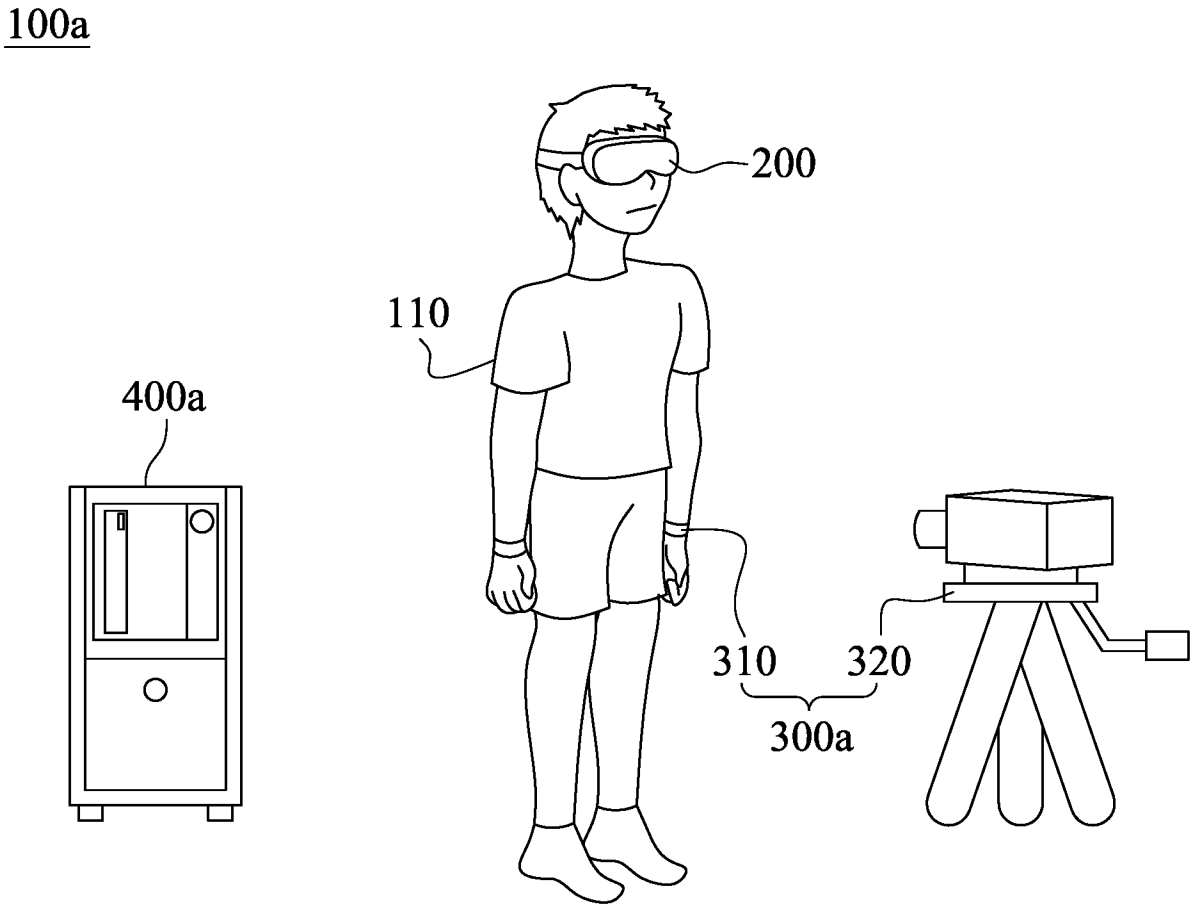
FIG. 2 shows a schematic view of a team sports vision training system based on extended reality, voice interaction and action recognition according to a second embodiment of the present disclosure.
Figure 3:
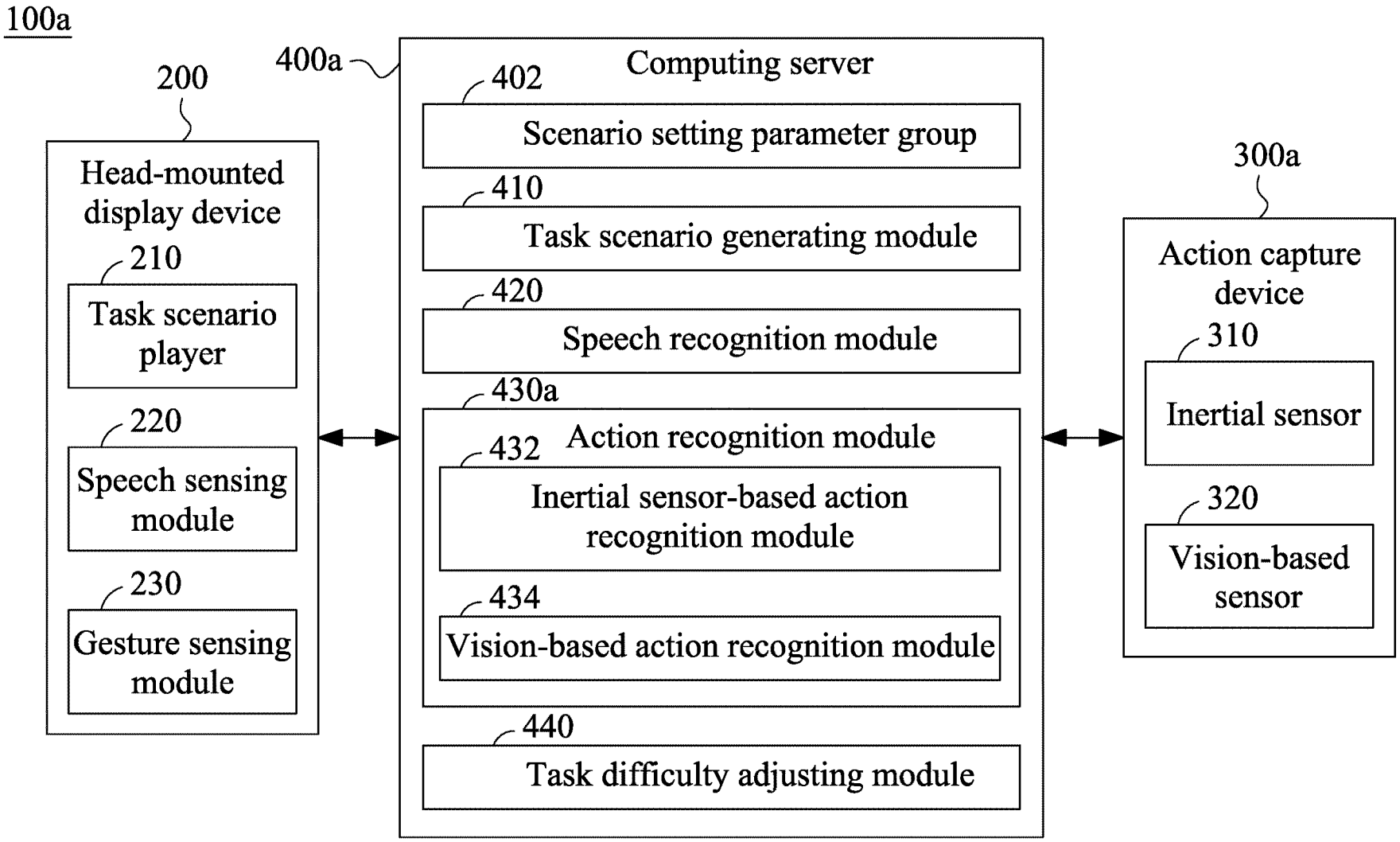
FIG. 3 shows a block diagram of the team sports vision training system based on extended reality, voice interaction and action recognition of FIG. 2.
Figure 4:
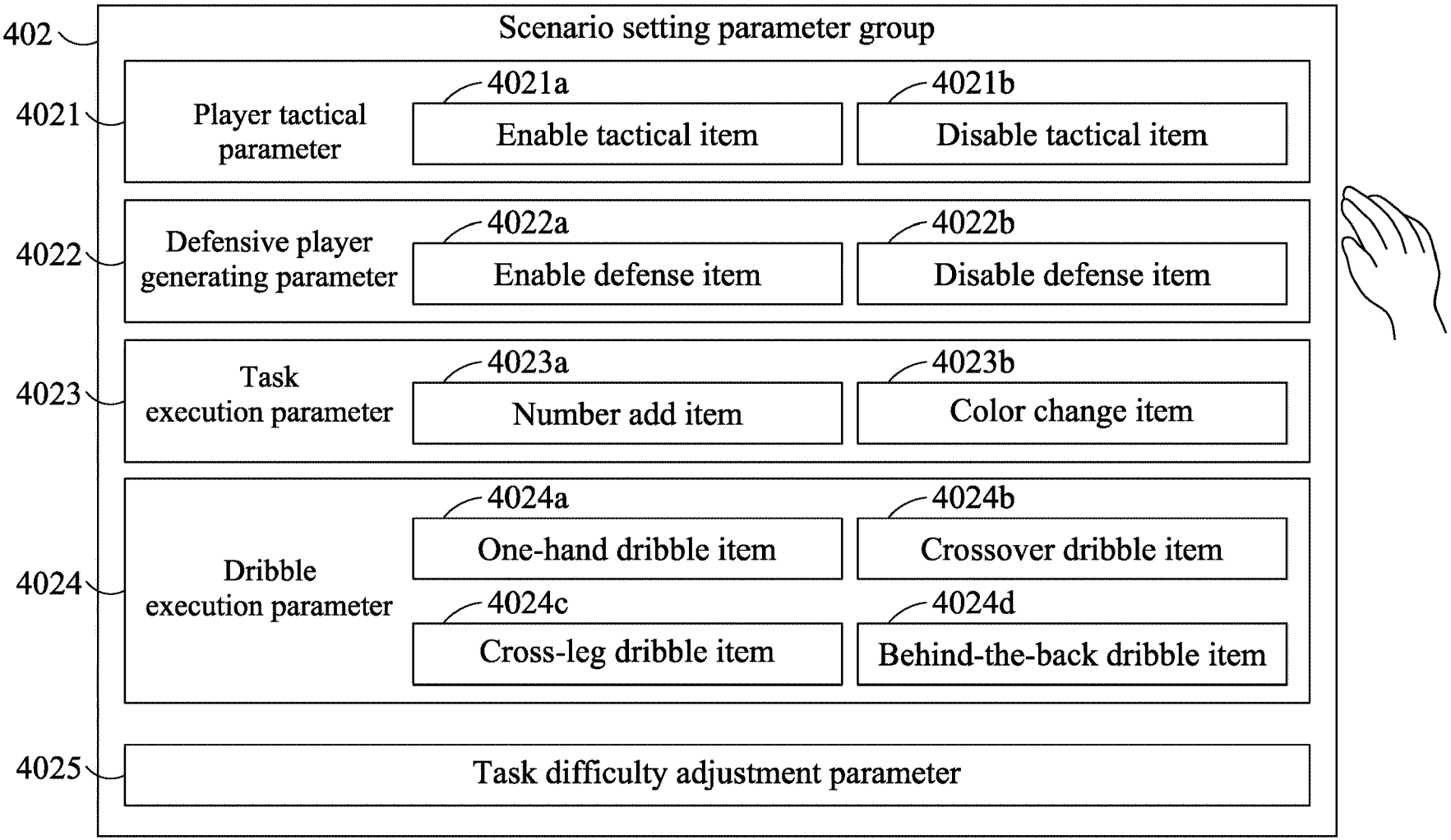
FIG. 4 shows a schematic view of a scenario setting parameter group stored in a computing server of FIG. 2.

Reference is made to FIGS. 1, 2, 3 and 4. FIG. 2 shows a schematic view of a team sports vision training system 100*a* based on extended reality, voice interaction and action recognition according to a second embodiment of the present disclosure. FIG. 3 shows a block diagram of the team sports vision training system 100*a* based on extended reality, voice interaction and action recognition of FIG. 2. FIG. 4 shows a schematic view of a scenario setting parameter group 402 stored in a computing server 400*a* of FIG. 2. The team sports vision training system 100*a* based on extended reality, voice interaction and action recognition is configured to train vision and an action of a user 110 and includes a head-mounted display device 200, an action capture device 300*a* and a computing server 400*a*.

The head-mounted display device 200 is disposed on the user 110 and includes a task scenario player 210, a speech sensing module 220 and a gesture sensing module 230. The task scenario player 210 is configured to show a virtual task scenario image. The speech sensing module 220 senses a speech signal of the user 110 to generate a speech message. The gesture sensing module 230 is configured to sense a gesture of the user 110 to generate a gesture sensing result. In one embodiment, the head-mounted display device 200 can be a mixed reality (MR) helmet or a virtual reality (VR)

helmet, and can be worn on the head of the user 110. The head-mounted display device 200 may transmit related information by a wireless type (e.g., wireless network or Bluetooth) or a wire type (the related information includes a virtual task scenario image transmitted from the computing server 400*a* to the task scenario player 210). The task scenario player 210 can be a screen. The speech sensing module 220 can be a microphone. The gesture sensing module 230 can be a camera. When the user 110 wears the head-mounted display device 200, the eyes corresponding to the screen can view a MR image or a VR image (i.e., the virtual task scenario image), and the microphone corresponding to the mouth can collect sound for subsequent processing, but the present disclosure is not limited thereto.

The action capture device 300*a* is configured to capture the action of the user 110 to generate an action message. In detail, the action capture device 300*a* includes an inertial sensor 310 and a vision-based sensor 320. The inertial sensor 310 is disposed on the user 110 and senses the action of the user 110 to generate an inertial action message. The inertial sensor 310 transmits the inertial action message to an action recognition module 430*a* of the computing server 400*a*. For example, when the user 110 dribbles, and the inertial sensor 310 is worn on a hand of the user 110, the inertial sensor 310 captures the dribbling action of the hand of the user 110, and the inertial action message generated by the inertial sensor 310 is equivalent to information about the movement of the sphere. In other words, when the sphere touches the hand during dribbling, the trajectory of the hand is the same as the movement trajectory of the sphere. In addition, the vision-based sensor 320 includes a camera facing the user 110. The vision-based sensor 320 captures the action of the user 110 via the camera to generate a vision-based action message, and transmits the vision-based action message to the action recognition module 430*a* of the computing server 400*a*. The action message includes the inertial action message and the vision-based action message. The vision-based sensor 320 can be a camera or a mobile phone. It is also worth mentioning that if the team sport is basketball, the inertial sensor 310 is worn on the hand of the user 110. If the team sport is football, the inertial sensor 310 is worn on a foot of the user 110, thus depending on the need of training.

The computing server 400*a* is signally connected to the head-mounted display device 200 and the action capture device 300*a*. The computing server 400*a* stores the scenario setting parameter group 402 and receives the action message and the speech message. The scenario setting parameter group 402 includes a player tactical parameter 4021, a defensive player generating parameter 4022, a task execution parameter 4023, a dribble execution parameter 4024 and a task difficulty adjustment parameter 4025. The player tactical parameter 4021 includes an enable tactical item 4021*a* and a disable tactical item 4021*b*. One of the enable tactical item 4021*a* and the disable tactical item 4021*b* is selected according to the gesture sensing result. The enable tactical item 4021*a* represents that a virtual player can move in the virtual task scenario image. The disable tactical item 4021*b* represents that the virtual player is stationary. In addition, the defensive player generating parameter 4022 includes an enable defense item 4022*a* and a disable defense item 4022*b*. One of the enable defense item 4022*a* and the disable defense item 4022*b* is selected according to the gesture sensing result. The defensive player is an opponent. The enable defense item 4022*a* represents that the virtual task scenario image will display virtual defensive players, i.e., the virtual task scenario image will simultaneously display a plurality of virtual teammates and a plurality of virtual defensive players. For example, when the team sport is basketball, and the enable defense item 4022*a* is selected, the virtual task scenario image will display four virtual teammates and five virtual defensive players. The disable defense item 4022*b* represents that the virtual task scenario image will only display the virtual teammates without the virtual defensive players.

The task execution parameter 4023 includes a number add item 4023*a* and a color change item 4023*b*. One of the number add item 4023*a* and the color change item 4023*b* is selected according to the gesture sensing result. The number add item 4023*a* represents that the numbers are displayed around virtual objects (e.g., the top of the head of the virtual teammates) of the virtual task scenario image, respectively, for the user 110 to watch and then generate the speech signal. The color change item 4023*b* represents that the numbers are displayed around the virtual objects (e.g., the top of the head of the virtual teammates), respectively, and a cloth of one of the virtual objects is changed from the first color to the second color for the user 110 to watch and then generate the speech signal. In addition, the dribble execution parameter 4024 includes a one-hand dribble item 4024*a*, a crossover dribble item 4024*b*, a cross-leg dribble item 4024*c* and a behind-the-back dribble item 4024*d*. One of the one-hand dribble item 4024*a*, the crossover dribble item 4024*b*, the cross-leg dribble item 4024*c* and the behind-the-back dribble item 4024*d* is selected according to the gesture sensing result. The one-hand dribble item 4024*a* represents that the user 110 should execute a one-hand dribble action. The crossover dribble item 4024*b* represents that the user 110 should execute a crossover dribble action. The cross-leg dribble item 4024*c* represents that the user 110 should execute a cross-leg dribble action. The behind-the-back dribble item 4024*d* represents that the user 110 should execute a behind-the-back dribble action, thus judging subsequent dribble posture and dribble stability.

The task difficulty adjustment parameter 4025 represents that the degree of difficulty of the task is controlled by adjusting parameters. The parameters to be capable of being adjusted include the player tactical parameter 4021, the defensive player generating parameter 4022, the task execution parameter 4023, the dribble execution parameter 4024, a movement speed of the virtual player or a time limit for voice interaction, but the present disclosure is not limited thereto. It can be seen from the above that the scenario setting parameter group 402 can be displayed in the virtual task scenario image, and the combination of the scenario setting parameter group 402, the virtual reality and the selection action allows the user 110 to select desired scenario parameters in the virtual task scenario image. In one embodiment, the virtual task scenario image correspondingly changes the color of the checkbox and the check content therein according to a position of a virtual human hand of the user 110, thereby completing the selection of the scenario parameters. In addition, the degree of difficulty of the task can be set by a coach. For example, the coach utilizes a specific device (e.g., the MR/VR helmet, a mobile device or a tablet computer) to set the degree of difficulty of the task. The specific device and the computing server 400*a* can transmit the related information corresponding to the degree of difficulty of the task by the wireless type or the wire type.

The computing server 400*a* includes a task scenario generating module 410, a speech recognition module 420, an action recognition module 430*a* and a task difficulty adjusting module 440. The task scenario generating module 410 generates the virtual task scenario image and a task parameter group according to the scenario setting parameter group 402, and transmits the virtual task scenario image to the head-mounted display device 200 for the user 110 to watch and then generate the speech signal and the action. The speech recognition module 420 receives the speech message and recognizes the speech message according to a speech recognition procedure to generate a speech recognition result. The speech recognition module 420 judges the task parameter group of the task scenario generating module 410 and the speech recognition result to generate a vision training result. In one embodiment, the speech recognition procedure can be Microsoft speech recognition software (Azure Cognitive Service), but the present disclosure is not limited thereto.

The action recognition module 430*a* receives the action message and recognizes the action message according to an action recognition procedure to generate an action recognition result. The action recognition module 430*a* judges the scenario setting parameter group 402 and the action recognition result to generate a sport training result. The vision training result and the sport training result are configured to judge whether the user 110 meets a training requirement. The action recognition procedure is realized by computer vision, signal processing and artificial intelligence technology. In detail, the action recognition module 430*a* includes an inertial sensor-based action recognition module 432 and a vision-based action recognition module 434. The inertial sensor-based action recognition module 432 recognizes the inertial action message to generate an inertial action recognition result, and judges whether the inertial action recognition result is the same as or similar to the one (i.e., the item selected by the user 110) of the one-hand dribble item 4024*a*, the crossover dribble item 4024*b*, the cross-leg dribble item 4024*c* and the behind-the-back dribble item 4024*d* of the dribble execution parameter 4024 of the scenario setting parameter group 402 to generate a first sport training result. Moreover, the vision-based action recognition module 434 recognizes the action message to generate the action recognition result, and judges whether the action recognition result is the same as or similar to the one of the one-hand dribble item 4024*a*, the crossover dribble item 4024*b*, the cross-leg dribble item 4024*c* and the behind-the-back dribble item 4024*d* of the dribble execution parameter 4024 of the scenario setting parameter group 402 to generate a second sport training result. The sport training result includes the first sport training result and the second sport training result. The present disclosure can effectively improve the accuracy of recognition via the dual recognition of inertial sensor-based action and vision-based action.

The task difficulty adjusting module 440 adjusts selection of the enable tactical item 4021*a* and the disable tactical item 4021*b* of the player tactical parameter 4021, the enable defense item 4022*a* and the disable defense item 4022*b* of the defensive player generating parameter 4022, the number add item 4023*a* and the color change item 4023*b* of the task execution parameter 4023, and the one-hand dribble item 4024*a*, the crossover dribble item 4024*b*, the cross-leg dribble item 4024*c* and the behind-the-back dribble item 4024*d* of the dribble execution parameter 4024 according to the task difficulty adjustment parameter 4025, thereby performing tasks for different degrees of difficulty. For example, a high-difficulty task may correspond to the enable tactical item 4021*a*, the enable defense item 4022*a*, the number add item 4023*a* and/or the behind-the-back dribble item 4024*d*. A low-difficulty task may correspond to the disable tactical item 4021*b*, the disable defense item 4022*b*, the color change item 4023*b* and/or the one-hand dribble item 4024*a*.

The computing server 400*a* includes a memory and a high-performance arithmetic processor for processing images. The memory can store the scenario setting parameter group 402, a plurality of virtual sport scenes, a speech recognition procedure and an action recognition procedure. The high-performance arithmetic processor for processing images is configured to process the MR image or the VR image (i.e., the virtual task scenario image) in real time, such as a central processing unit (CPU) or a graphics processing unit (GPU). The computing server 400*a* can be a computer, a mobile device or other high-speed electronic computing device, but the present disclosure is not limited thereto. Therefore, the team sports vision training system 100*a* based on extended reality, voice interaction and action recognition of the present disclosure utilizes an extended reality helmet combined with voice interaction and action recognition technologies to be capable of effectively assisting the user 110 (e.g., athletes or players) in conducting vision training, and making it easier for the user 110 to grasp the movements of teammates on an ever-changing court, and then helping the team score and win. In addition, the present disclosure can realize individual training to avoid the problem of high manpower costs in training due to the need for repeated practice by multiple people on the physical court in a conventional technique.

Figure 5:
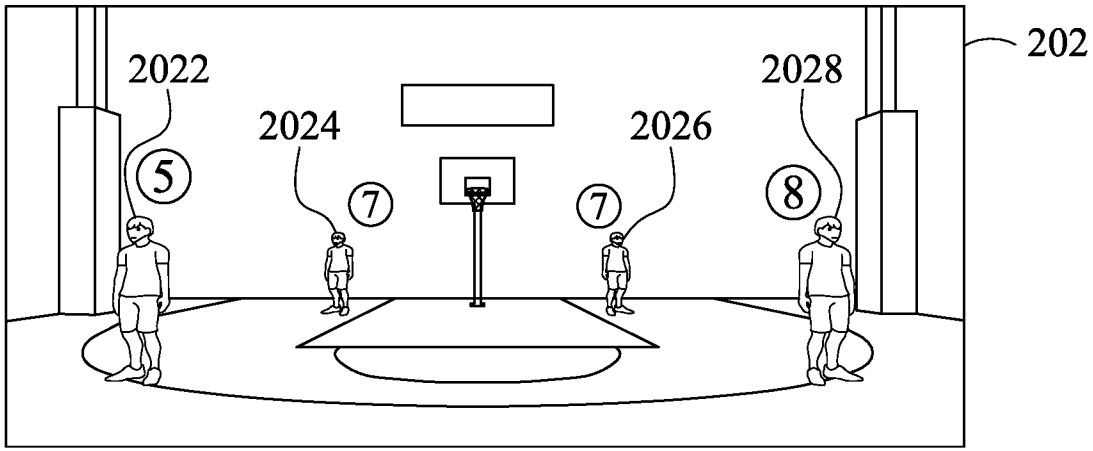
FIG. 5 shows a schematic view of one example of a virtual task scenario image of a head-mounted display device of FIG. 2.

Reference is made to FIGS. 2, 3, 4 and 5. FIG. 5 shows a schematic view of one example of a virtual task scenario image 202 of a head-mounted display device 200 of FIG. 2. The virtual task scenario image 202 includes a plurality of virtual objects 2022, 2024, 2026, 2028 and a plurality of numbers. In response to determining that the number add item 4023*a* is selected according to the gesture sensing result, the numbers are displayed around the virtual objects 2022, 2024, 2026, 2028, respectively, for the user 110 to watch and then generate the speech signal. The speech recognition module 420 judges whether the speech recognition result corresponding to the speech signal is the same as a number add value of the task parameter group of the task scenario generating module 410 to generate the vision training result, and the number add value is equal to a sum of the numbers. For example, when the team sport is basketball, the virtual objects 2022, 2024, 2026, 2028 are the virtual teammates, and the numbers displayed at the tops of the heads of the virtual teammates are 5, 7, 7, 8, respectively. The sum of the numbers is equal to 27. When the speech recognition module 420 judges that the speech recognition result is the same as the number add value, the vision training result is "the number add value spoken by the user is correct", and is configured to judge that the user 110 meets the training requirement (this belongs to cognitive training of vision training). When the speech recognition module 420 judges that the speech recognition result is different from the number add value, the vision training result is "the number add value spoken by the user is not correct", and is configured to judge that the user 110 does not meet the training requirement.

Figure 6:
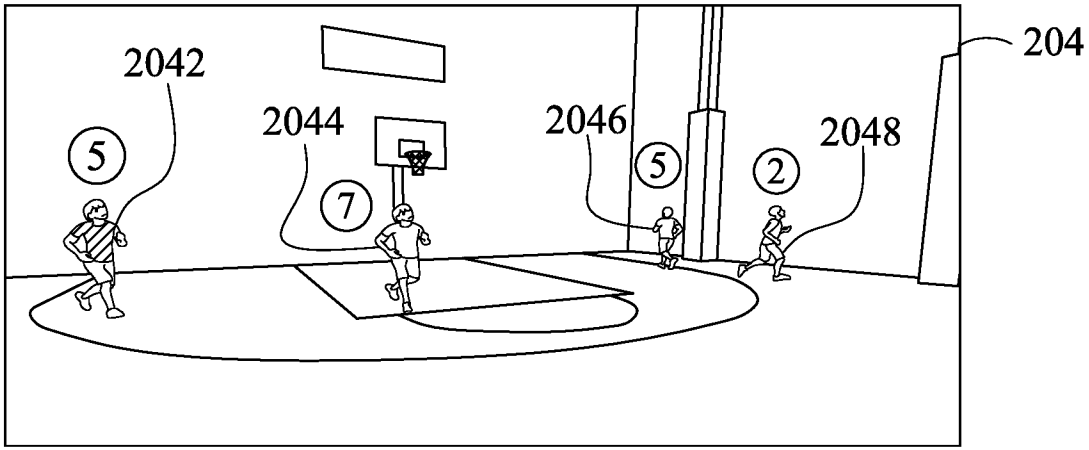
FIG. 6 shows a schematic view of another example of the virtual task scenario image of the head-mounted display device of FIG. 2.

Reference is made to FIGS. 2, 3, 4 and 6. FIG. 6 shows a schematic view of another example of the virtual task scenario image 204 of the head-mounted display device 200 of FIG. 2. The virtual task scenario image 204 includes a plurality of virtual objects 2042, 2044, 2046, 2048, a plurality of numbers, a first color and a second color. The first color is different from the second color. In response to determining that the color change item 4023*b* is selected according to the gesture sensing result, the numbers are displayed around the virtual objects 2042, 2044, 2046, 2048, respectively. One of the virtual objects 2042, 2044, 2046, 2048 is changed from the first color to the second color for the user 110 to watch and then generate the speech signal. The speech recognition module 420 judges whether the speech recognition result corresponding to the speech signal is the same as a color change number of the task parameter group of the task scenario generating module 410 to generate the vision training result. The color change number is equal to one of the numbers displayed around the one of the virtual objects 2042, 2044, 2046, 2048. For example, when the team sport is basketball, the virtual objects 2042, 2044, 2046, 2048 are the virtual teammates, and the numbers displayed at the tops of the heads of the virtual teammates are 5, 7, 5, 2, respectively. When the speech recognition module 420 judges that the speech recognition result is the same as the color change number (the teammate with a color change cloth is the virtual object 2042, and its color change number is 5), the vision training result is "the color change number spoken by the user is correct", and is configured to judge that the user 110 meets the training requirement (this belongs to response training of vision training). When the speech recognition module 420 judges that the speech recognition result is different from the color change number, the vision training result is "the color change number spoken by the user is not correct", and is configured to judge that the user 110 does not meet the training requirement.

Figure 7:
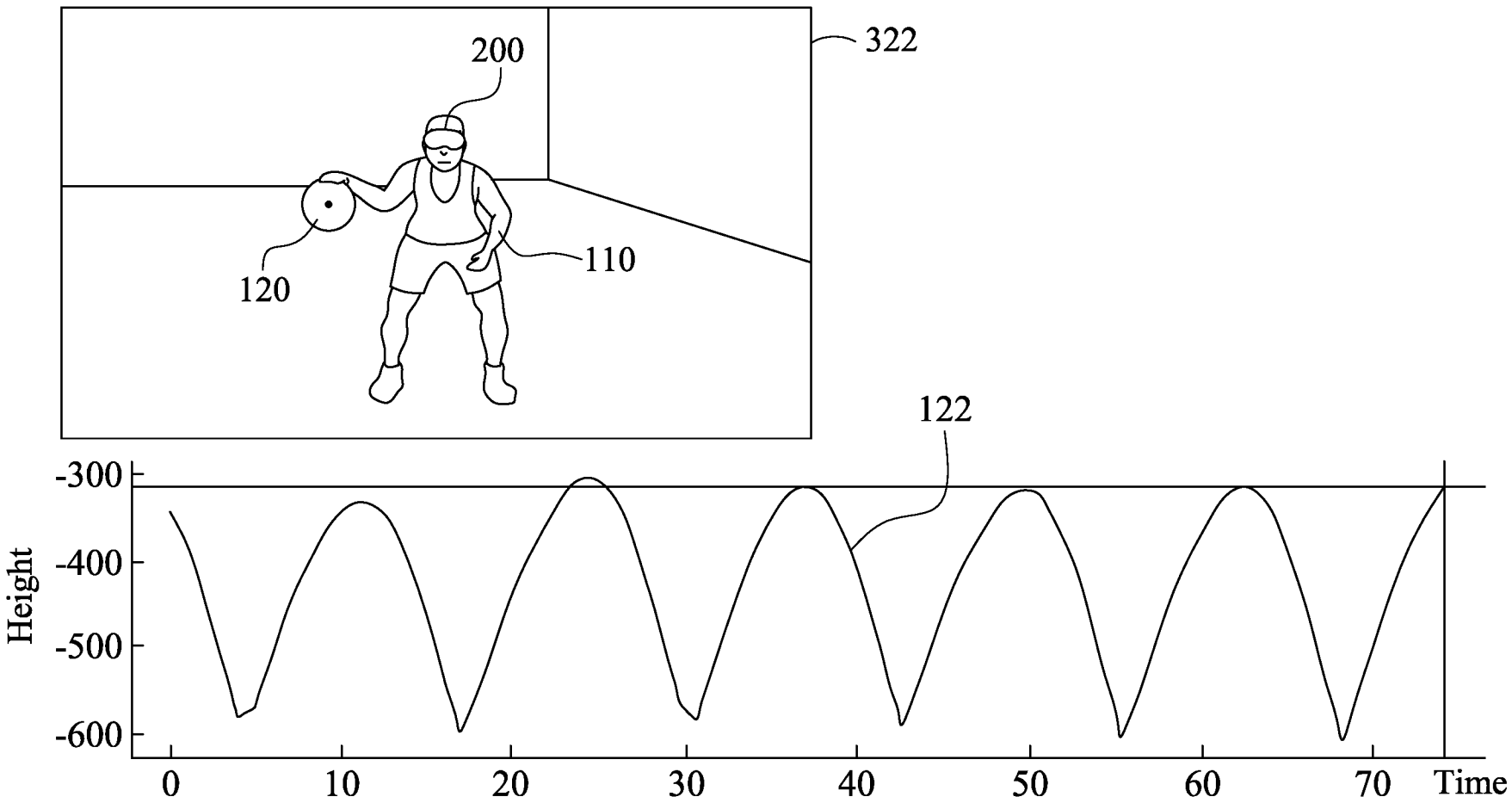
FIG. 7 shows a schematic view of an image captured by a vision-based sensor and a movement trajectory obtained by recognizing a sphere in the image via the computing server of FIG. 2.

Reference is made to FIGS. 2, 3, 4 and 7. FIG. 7 shows a schematic view of an image 322 captured by a vision-based sensor 320 and a movement trajectory 122 obtained by recognizing a sphere 120 in the image 322 via the computing server 400*a* of FIG. 2. The image 322 captured by the vision-based sensor 320 is sent to the computing server 400*a* for recognition. The vision-based action recognition module 434 recognizes the action message of the user 110 in the image 322 to generate the action recognition result, and judges whether the action recognition result is the same as or similar to the one of the one-hand dribble item 4024*a*, the crossover dribble item 4024*b*, the cross-leg dribble item 4024*c* and the behind-the-back dribble item 4024*d* of the dribble execution parameter 4024 of the scenario setting parameter group 402 to generate a second sport training result, thereby analyzing the dribble posture of the user 110. In addition, the vision-based action recognition module 434 recognizes the sphere 120 in the image 322 to obtain the movement trajectory 122 of the sphere 120, thereby analyzing the dribble stability of the user 110. The stability is positively correlated with a frequency of a waveform of the movement trajectory 122. For example, when the team sport is basketball, the user 110 dribbles with one hand. When the vision-based action recognition module 434 judges that the action recognition result is the same as the one-hand dribble item 4024*a*, and the frequency of the waveform of the movement trajectory 122 is within a predetermined range, the second sport training result is "the dribble posture of the user is correct" and "high dribble stability", and is configured to judge that the user 110 meets the training requirement. When the vision-based action recognition module 434 judges that the action recognition result is different from the one-hand dribble item 4024*a*, and the frequency of the waveform of the movement trajectory 122 is out of a predetermined range, the second sport training result is "the dribble posture of the user is not correct" and "low dribble stability", and is configured to judge that the user 110 does not meet the training requirement.

Figure 8:
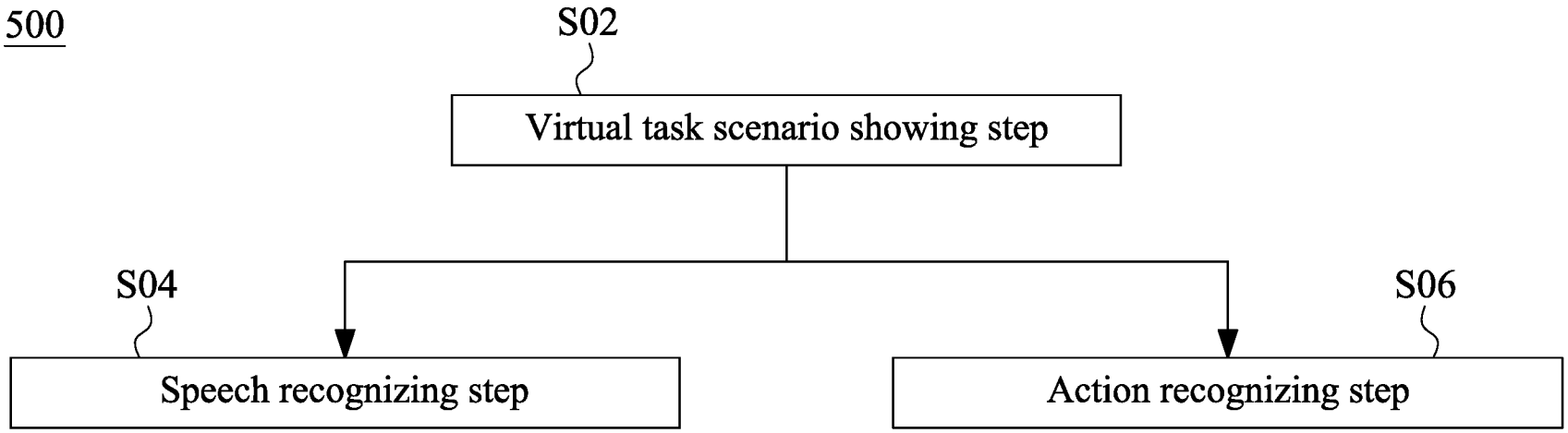
FIG. 8 shows a flow chart of a team sports vision training method based on extended reality, voice interaction and action recognition according to a third embodiment of the present disclosure.

Reference is made to FIGS. 2 and 8. FIG. 8 shows a flow chart of a team sports vision training method 500 based on extended reality, voice interaction and action recognition according to a third embodiment of the present disclosure. The team sports vision training method 500 based on extended reality, voice interaction and action recognition may be applied to the team sports vision training system 100 based on extended reality, voice interaction and action recognition, and is configured to train vision and an action of a user 110. The team sports vision training method 500 based on extended reality, voice interaction and action recognition includes performing a virtual task scenario showing step S02, a speech recognizing step S04 and an action recognizing step S06. The virtual task scenario showing step S02 includes disposing a head-mounted display device 200 on the user 110, configuring a task scenario generating module 410 of a computing server 400 to generate a virtual task scenario image and a task parameter group according to a scenario setting parameter group and transmit the virtual task scenario image to the head-mounted display device 200, and then configuring a task scenario player 210 of the head-mounted display device 200 to show the virtual task scenario image for the user 110 to watch and then generate a speech signal and the action. In addition, the speech recognizing step S04 includes configuring a speech sensing module 220 of the head-mounted display device 200 to sense a speech signal of the user 110 to generate a speech message, and then configuring a speech recognition module 420 of the computing server 400 to receive the speech message and recognize the speech message according to a speech recognition procedure to generate a speech recognition result, and judge the task parameter group of the task scenario generating module 410 and the speech recognition result to generate a vision training result. Moreover, the action recognizing step S06 includes configuring an action capture device 300 to capture the action of the user 110 to generate an action message, and then configuring an action recognition module 430 of the computing server 400 to receive the action message and recognize the action message according to an action recognition procedure to generate an action recognition result, and judge the scenario setting parameter group and the action recognition result to generate a sport training result. The vision training result and the sport training result are configured to judge whether the user 110 meets a training requirement. Therefore, the team sports vision training method 500 based on extended reality, voice interaction and action recognition of the present disclosure utilizes an extended reality helmet combined with voice interaction and action recognition technologies to be capable of effectively assisting the user 110 (e.g., athletes or players) in conducting vision training, and making it easier for the user 110 to grasp the movements of teammates on an ever-changing court, and then helping the team score and win. In addition, the present disclosure can realize individual training to avoid the problem of high manpower costs in training due to the need for repeated practice by multiple people on the physical court in a conventional technique.

Figure 9:
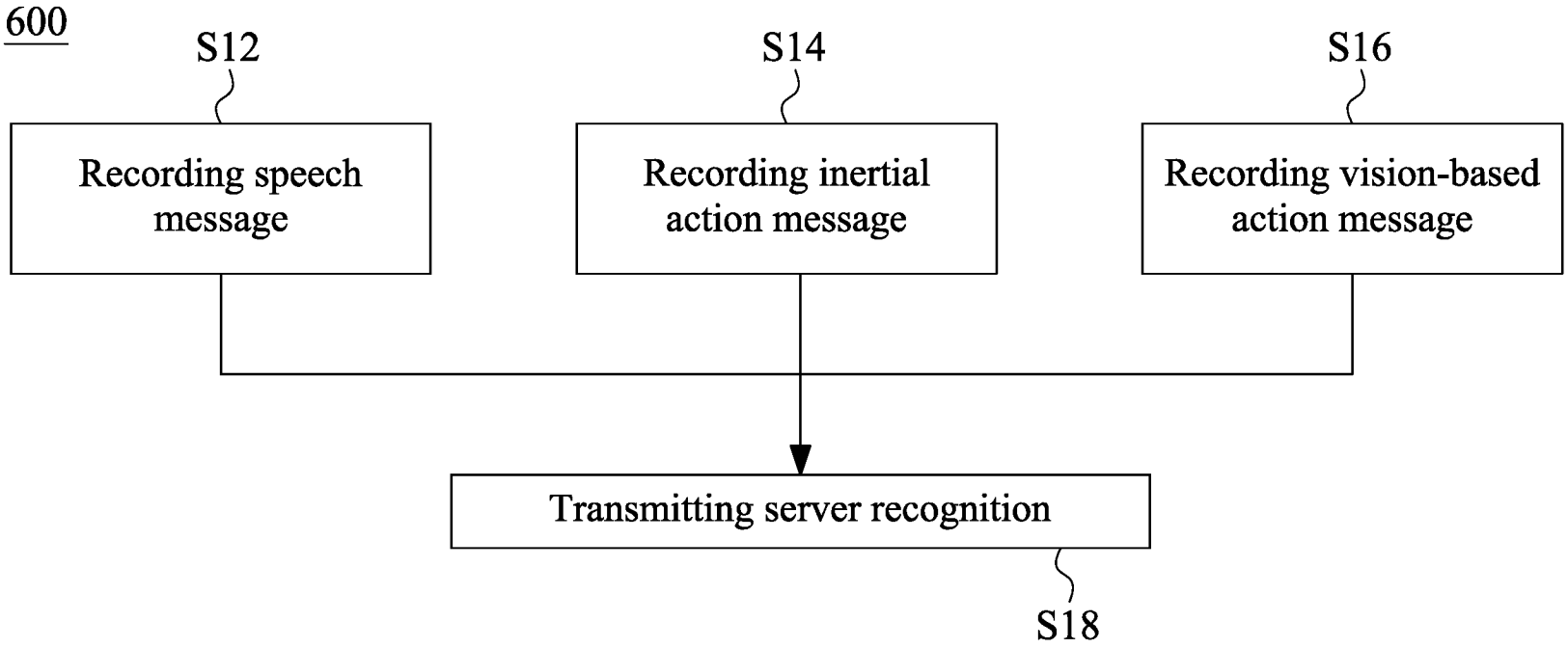
FIG. 9 shows a flow chart of a team sports vision training method based on extended reality, voice interaction and action recognition according to a fourth embodiment of the present disclosure.

Reference is made to FIGS. 2, 3 and 9. FIG. 9 shows a flow chart of a team sports vision training method 600 based on extended reality, voice interaction and action recognition according to a fourth embodiment of the present disclosure. The team sports vision training method 600 based on extended reality, voice interaction and action recognition includes performing a plurality of steps S12, S14, S16, S18. The step S12 is "Recording speech message", and includes configuring the speech sensing module 220 of the head-mounted display device 200 to sense the speech signal of the user 110 to generate and record the speech message. The step S14 is "Recording inertial action message", and includes configuring the inertial sensor 310 of the action capture device 300*a* to sense the action of the user 110 to generate and record the inertial action message. The step S16 is "Recording vision-based action message", and includes configuring the vision-based sensor 320 of the action capture device 300*a* to capture the action of the user 110 via the camera to generate and record the vision-based action message. The step S18 is "Transmitting server recognition", and includes configuring the speech sensing module 220, the inertial sensor 310 and the vision-based sensor 320 to transmit the speech message, the inertial action message and the vision-based action message to the speech recognition module 420 of the computing server 400*a*, the inertial sensor-based action recognition module 432 and the vision-based action recognition module 434 of the action recognition module 430*a* for recognition so as to generate the vision training result and the sport training result. Therefore, the team sports vision training method 600 based on extended reality, voice interaction and action recognition of the present disclosure utilizes the interaction of an extended reality helmet, voice interaction and action recognition technologies to be capable of effectively assisting the user 110 (e.g., athletes or players) in conducting vision training and sport training, and making it easier for the user 110 to grasp the movements of teammates on an ever-changing court, and then helping the team score and win. In addition, the present disclosure can avoid the problem of high manpower costs in training due to the need for repeated practice by multiple people on the physical court in a conventional technique.

Figure 10:
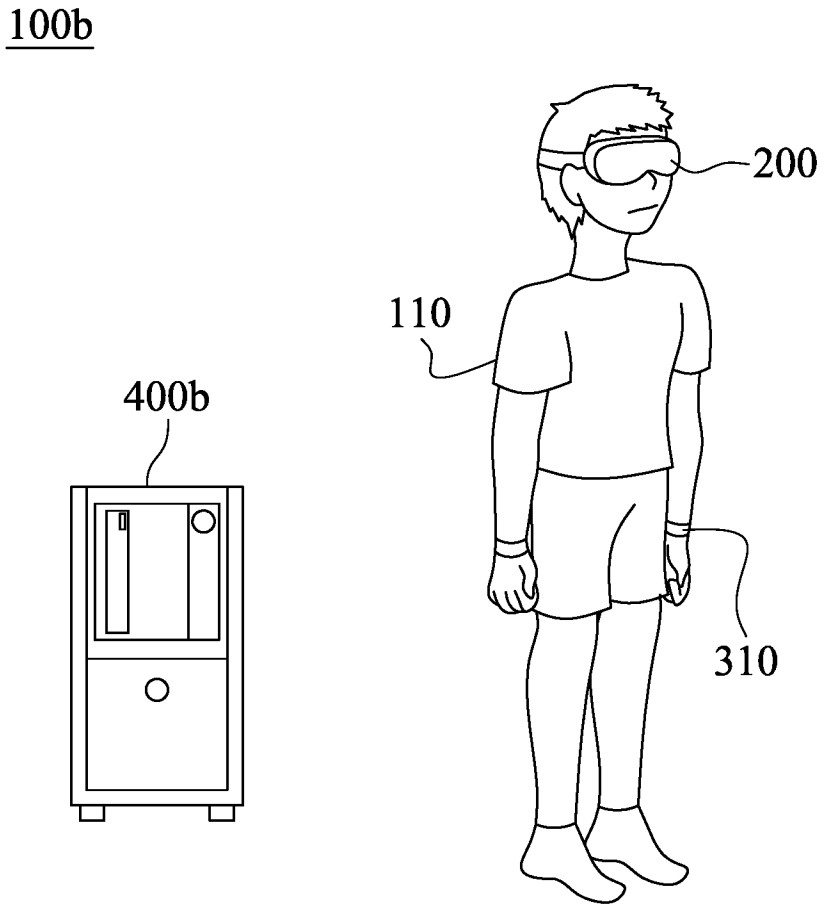
FIG. 10 shows a schematic view of a team sports vision training system based on extended reality, voice interaction and action recognition according to a fifth embodiment of the present disclosure.

Reference is made to FIGS. 1, 3, 4 and 10. FIG. 10 shows a schematic view of a team sports vision training system 100*b* based on extended reality, voice interaction and action recognition according to a fifth embodiment of the present disclosure. The team sports vision training system 100*b* based on extended reality, voice interaction and action recognition is configured to train vision and an action of a user 110, and includes a head-mounted display device 200, an action capture device and a computing server 400*b*. The head-mounted display device 200 is the same as the head-mounted display device 200 of FIG. 1. The action capture device is an inertial sensor 310. The inertial sensor 310 is disposed on the user 110 and senses the action of the user 110 to generate the action message, and transmits the action message to an action recognition module of the computing server 400*b*. The computing server 400*b* stores a scenario setting parameter group 402, and includes a task scenario generating module 410, a speech recognition module 420, the action recognition module and a task difficulty adjusting module 440. The scenario setting parameter group 402, the task scenario generating module 410, the speech recognition module 420 and the task difficulty adjusting module 440 are respectively the same as the scenario setting parameter group 402, the task scenario generating module 410, the speech recognition module 420 and the task difficulty adjusting module 440 of FIGS. 3 and 4, and will not be described again herein. In particular, the action recognition module of the computing server 400*b* is an inertial sensor-based action recognition module. The inertial sensor-based action recognition module recognizes the action message to generate the action recognition result, and judges whether the action recognition result is the same as or similar to the one of the one-hand dribble item 4024*a*, the crossover dribble item 4024*b*, the cross-leg dribble item 4024*c* and the behind-the-back dribble item 4024*d* of the dribble execution parameter 4024 of the scenario setting parameter group 402 to generate the sport training result. Therefore, the team sports vision training system 100*b* based on extended reality, voice interaction and action recognition of the present disclosure can conduct team vision training and sport training in a single-player mode only via the inertial sensor 310 and the inertial sensor-based action recognition module of the computing server 400*b*, and the installation is simple and convenient.

Figure 11:
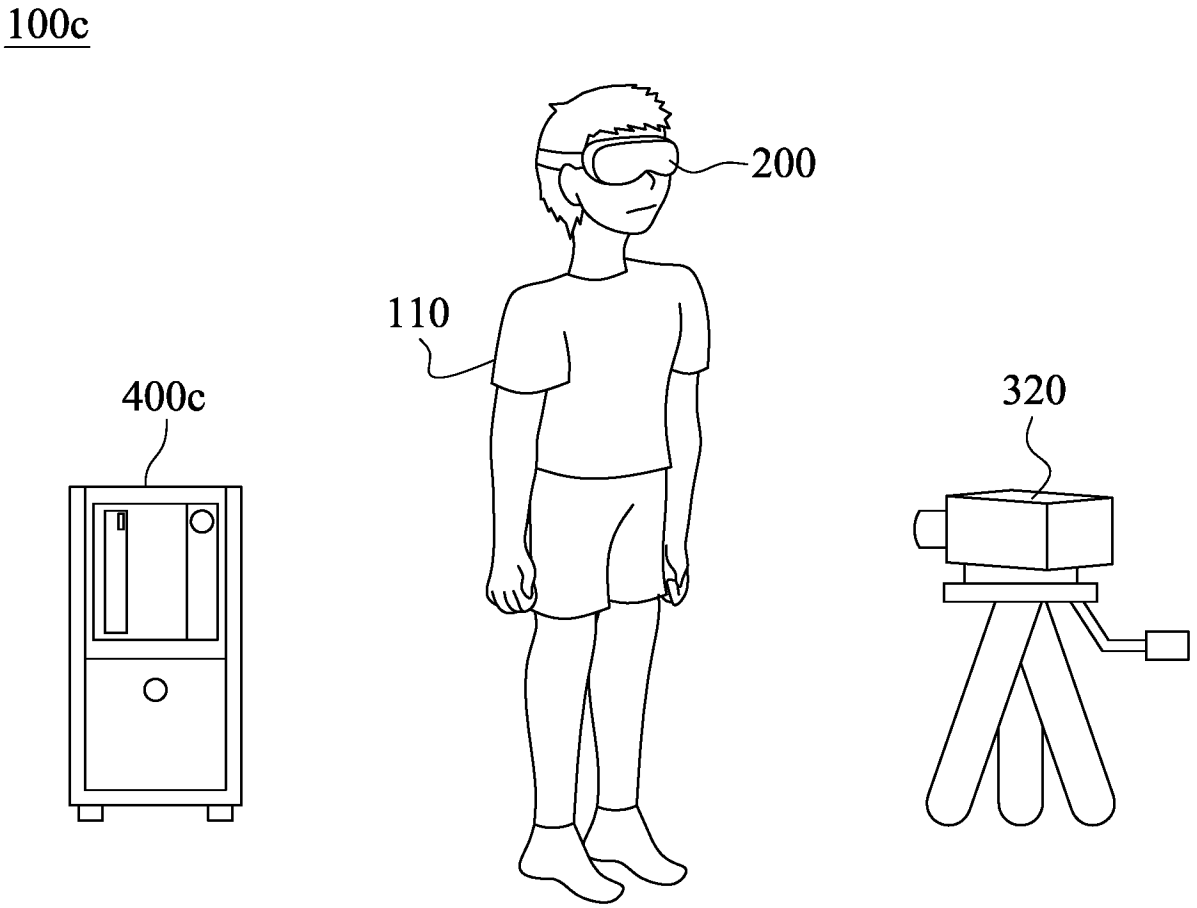
FIG. 11 shows a schematic view of a team sports vision training system based on extended reality, voice interaction and action recognition according to a sixth embodiment of the present disclosure.

Reference is made to FIGS. 1, 3, 4 and 11. FIG. 11 shows a schematic view of a team sports vision training system 100*c* based on extended reality, voice interaction and action recognition according to a sixth embodiment of the present disclosure. The team sports vision training system 100*c* based on extended reality, voice interaction and action recognition is configured to train vision and an action of a user 110, and includes a head-mounted display device 200, an action capture device and a computing server 400*c*. The head-mounted display device 200 is the same as the head-mounted display device 200 of FIG. 1. The action capture device is a vision-based sensor 320. The vision-based sensor 320 includes a camera facing the user 110. The vision-based sensor 320 captures the action of the user 110 via the camera to generate the action message, and transmits the action message to an action recognition module of the computing server 400*c*. The computing server 400*c* stores a scenario setting parameter group 402, and includes a task scenario generating module 410, a speech recognition module 420, the action recognition module and a task difficulty adjusting module 440. The scenario setting parameter group 402, the task scenario generating module 410, the speech recognition module 420 and the task difficulty adjusting module 440 are respectively the same as the scenario setting parameter group 402, the task scenario generating module 410, the speech recognition module 420 and the task difficulty adjusting module 440 of FIGS. 3 and 4, and will not be described again herein. In particular, the action recognition module of the computing server 400*c* is a vision-based action recognition module. The vision-based action recognition module recognizes the action message to generate the action recognition result, and judges whether the action recognition result is the same as or similar to the one of the one-hand dribble item 4024*a*, the crossover dribble item 4024*b*, the cross-leg dribble item 4024*c* and the behind-the-back dribble item 4024*d* of the dribble execution parameter 4024 of the scenario setting parameter group 402 to generate the sport training result. Therefore, the team sports vision training system 100*c* based on extended reality, voice interaction and action recognition of the present disclosure can conduct team vision training and sport training in a single-player mode only via the vision-based sensor 320 and the vision-based action recognition module of the computing server 400*c*, and the installation is simple and convenient.

According to the aforementioned embodiments and examples, the advantages of the present disclosure are described as follows.

1. The team sports vision training system based on extended reality, voice interaction and action recognition and the method thereof of the present disclosure utilize an extended reality helmet combined with voice interaction and action recognition technologies to be capable of effectively assisting the user in conducting vision training, and making it easier for the user to grasp the movements of teammates on an ever-changing court, and then helping the team score and win, so that the present disclosure can avoid the problem of high manpower costs in training due to the need for repeated practice by multiple people on the physical court in a conventional technique.

2. The team sports vision training system based on extended reality, voice interaction and action recognition and the method thereof of the present disclosure allow the user to wear the extended reality helmet to conduct first-person tactical execution in a simulated situation, and can be combined with a simple action capture system (the inertial sensor or the vision-based sensor) to record the action of the user. When the user watches the virtual content to complete the vision training task, the action capture system recognizes the action of the user in real time and judges whether the user can conduct the specified dribble action synchronously, and then trains the dribble stability of the user.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A team sports vision training system based on extended reality, voice interaction and action recognition, which is configured to train vision and an action of a user, and the team sports vision training system based on extended reality, voice interaction and action recognition comprising:

a head-mounted display device disposed on the user and comprising:

a task scenario player showing a virtual task scenario image; and a speech sensing module sensing a speech signal of the user to generate a speech message;

an action capture device capturing the action of the user to generate an action message; and a computing server signally connected to the head-mounted display device and the action capture device, wherein the computing server stores a scenario setting parameter group and receives the action message and the speech message, and the computing server comprises:

a task scenario generating module generating the virtual task scenario image and a task parameter group according to the scenario setting parameter group, and transmitting the virtual task scenario image to the head-mounted display device for the user to watch and then generate the speech signal and the action;

a speech recognition module receiving the speech message and recognizing the speech message according to a speech recognition procedure to generate a speech recognition result, wherein the speech recognition module judges the task parameter group of the task scenario generating module and the speech recognition result to generate a vision training result; and an action recognition module receiving the action message and recognizing the action message according to an action recognition procedure to generate an action recognition result, wherein the action recognition module judges the scenario setting parameter group and the action recognition result to generate a sport training result;

wherein the vision training result and the sport training result are configured to judge whether the user meets a training requirement;

wherein the head-mounted display device further comprises a gesture sensing module, the gesture sensing module is configured to sense a gesture of the user to generate a gesture sensing result, and the scenario setting parameter group comprises:

a task execution parameter comprising a number add item and a color change item, wherein one of the number add item and the color change item is selected according to the gesture sensing result;

wherein the virtual task scenario image comprises a plurality of virtual objects and a plurality of numbers; and in response to determining that the number add item is selected according to the gesture sensing result, the numbers are displayed around the virtual objects, respectively, for the user to watch and then generate the speech signal, the speech recognition module judges whether the speech recognition result corresponding to the speech signal is the same as a number add value of the number add item of the scenario setting parameter group to generate the vision training result, and the number add value is equal to a sum of the numbers.

2. The team sports vision training system based on extended reality, voice interaction and action recognition of claim 1, wherein the scenario setting parameter group further comprises:

a player tactical parameter comprising an enable tactical item and a disable tactical item, wherein one of the enable tactical item and the disable tactical item is selected according to the gesture sensing result;

a defensive player generating parameter comprising an enable defense item and a disable defense item, wherein one of the enable defense item and the disable defense item is selected according to the gesture sensing result;

and a dribble execution parameter comprising a one-hand dribble item, a crossover dribble item, a cross-leg dribble item and a behind-the-back dribble item, wherein one of the one-hand dribble item, the crossover dribble item, the cross-leg dribble item and the behind-the-back dribble item is selected according to the gesture sensing result.

3. The team sports vision training system based on extended reality, voice interaction and action recognition of claim 2, wherein, the action capture device is an inertial sensor, the inertial sensor is disposed on the user and senses the action of the user to generate the action message, and transmits the action message to the action recognition module of the computing server; and the action recognition module is an inertial sensor-based action recognition module, the inertial sensor-based action recognition module recognizes the action message to generate the action recognition result, and judges whether the action recognition result is the same as or similar to the one of the one-hand dribble item, the crossover dribble item, the cross-leg dribble item and the behind-the-back dribble item of the dribble execution parameter of the scenario setting parameter group to generate the sport training result.

4. The team sports vision training system based on extended reality, voice interaction and action recognition of claim 2, wherein, the action capture device is a vision-based sensor, the vision-based sensor comprises a camera facing the user, the vision-based sensor captures the action of the user via the camera to generate the action message, and transmits the action message to the action recognition module of the computing server; and the action recognition module is a vision-based action recognition module, the vision-based action recognition module recognizes the action message to generate the action recognition result, and judges whether the action recognition result is the same as or similar to the one of the one-hand dribble item, the crossover dribble item, the cross-leg dribble item and the behind-the-back dribble item of the dribble execution parameter of the scenario setting parameter group to generate the sport training result.

5. The team sports vision training system based on extended reality, voice interaction and action recognition of claim 2, wherein the action capture device comprises:

an inertial sensor disposed on the user and sensing the action of the user to generate an inertial action message, wherein the inertial sensor transmits the inertial action message to the action recognition module of the computing server; and a vision-based sensor comprising a camera facing the user, wherein the vision-based sensor captures the action of the user via the camera to generate a vision-based action message, and transmits the vision-based action message to the action recognition module of the computing server;

wherein the action message comprises the inertial action message and the vision-based action message.

6. The team sports vision training system based on extended reality, voice interaction and action recognition of claim 5, wherein the action recognition module comprises:

an inertial sensor-based action recognition module recognizing the inertial action message to generate an inertial action recognition result, and judging whether the inertial action recognition result is the same as or similar to the one of the one-hand dribble item, the crossover dribble item, the cross-leg dribble item and the behind-the-back dribble item of the dribble execution parameter of the scenario setting parameter group to generate a first sport training result; and a vision-based action recognition module recognizing the action message to generate the action recognition result, and judging whether the action recognition result is the same as or similar to the one of the one-hand dribble item, the crossover dribble item, the cross-leg dribble item and the behind-the-back dribble item of the dribble execution parameter of the scenario setting parameter group to generate a second sport training result;

wherein the sport training result comprises the first sport training result and the second sport training result.

7. The team sports vision training system based on extended reality, voice interaction and action recognition of claim 1 wherein, the virtual task scenario image further comprises a first color and a second color, and the first color is different from the second color; and in response to determining that the color change item is selected according to the gesture sensing result, the numbers are displayed around the virtual objects, respectively, one of the virtual objects is changed from the first color to the second color for the user to watch and then generate the speech signal, the speech recognition module judges whether the speech recognition result corresponding to the speech signal is the same as a color change number of the color change item of the scenario setting parameter group to generate the vision training result, and the color change number is equal to one of the numbers displayed around the one of the virtual objects.

8. The team sports vision training system based on extended reality, voice interaction and action recognition of claim 2, wherein the scenario setting parameter group further comprises a task difficulty adjustment parameter, and the computing server further comprises:

a task difficulty adjusting module adjusting selection of the enable tactical item and the disable tactical item of the player tactical parameter, the enable defense item and the disable defense item of the defensive player generating parameter, the number add item and the color change item of the task execution parameter, and the one-hand dribble item, the crossover dribble item, the cross-leg dribble item and the behind-the-back dribble item of the dribble execution parameter according to the task difficulty adjustment parameter.

9. A team sports vision training method based on extended reality, voice interaction and action recognition, which is configured to train vision and an action of a user, and the team sports vision training method based on extended reality, voice interaction and action recognition comprising:

performing a virtual task scenario showing step, wherein the virtual task scenario showing step comprises disposing a head-mounted display device on the user, configuring a task scenario generating module of a computing server to generate a virtual task scenario image and a task parameter group according to a scenario setting parameter group and transmit the virtual task scenario image to the head-mounted display device, and then configuring a task scenario player of the head-mounted display device to show the virtual task scenario image for the user to watch and then generate a speech signal and the action;

performing a speech recognizing step, wherein the speech recognizing step comprises configuring a speech sensing module of the head-mounted display device to sense a speech signal of the user to generate a speech message, and then configuring a speech recognition module of the computing server to receive the speech message and recognize the speech message according to a speech recognition procedure to generate a speech recognition result, and judge the task parameter group of the task scenario generating module and the speech recognition result to generate a vision training result; and performing an action recognizing step, wherein the action recognizing step comprises configuring an action capture device to capture the action of the user to generate an action message, and then configuring an action recognition module of the computing server to receive the action message and recognize the action message according to an action recognition procedure to generate an action recognition result, and judge the scenario setting parameter group and the action recognition result to generate a sport training result;

wherein the vision training result and the sport training result are configured to judge whether the user meets a training requirement;

wherein the head-mounted display device further comprises a gesture sensing module, the gesture sensing module is configured to sense a gesture of the user to generate a gesture sensing result, and the scenario setting parameter group comprises:

a task execution parameter comprising a number add item and a color change item, wherein one of the number add item and the color change item is selected according to the gesture sensing result;

wherein the virtual task scenario image comprises a plurality of virtual objects and a plurality of numbers; and in response to determining that the number add item is selected according to the gesture sensing result, the numbers are displayed around the virtual objects, respectively, for the user to watch and then generate the speech signal, the speech recognition module judges whether the speech recognition result corresponding to the speech signal is the same as a number add value of the number add item of the scenario setting parameter group to generate the vision training result, and the number add value is equal to a sum of the numbers.

10. The team sports vision training method based on extended reality, voice interaction and action recognition of claim 9, wherein the scenario setting parameter group further comprises:

a player tactical parameter comprising an enable tactical item and a disable tactical item, wherein one of the enable tactical item and the disable tactical item is selected according to the gesture sensing result;

a defensive player generating parameter comprising an enable defense item and a disable defense item, wherein one of the enable defense item and the disable defense item is selected according to the gesture sensing result;

and a dribble execution parameter comprising a one-hand dribble item, a crossover dribble item, a cross-leg dribble item and a behind-the-back dribble item, wherein one of the one-hand dribble item, the crossover dribble item, the cross-leg dribble item and the behind-the-back dribble item is selected according to the gesture sensing result.

11. The team sports vision training method based on extended reality, voice interaction and action recognition of claim 10, wherein in the action recognizing step, the action capture device is an inertial sensor, the inertial sensor is disposed on the user and senses the action of the user to generate the action message, and transmits the action message to the action recognition module of the computing server; and the action recognition module is an inertial sensor-based action recognition module, the inertial sensor-based action recognition module recognizes the action message to generate the action recognition result, and judges whether the action recognition result is the same as or similar to the one of the one-hand dribble item, the crossover dribble item, the cross-leg dribble item and the behind-the-back dribble item of the dribble execution parameter of the scenario setting parameter group to generate the sport training result.

12. The team sports vision training method based on extended reality, voice interaction and action recognition of claim 10, wherein in the action recognizing step, the action capture device is a vision-based sensor, the vision-based sensor comprises a camera facing the user, the vision-based sensor captures the action of the user via the camera to generate the action message, and transmits the action message to the action recognition module of the computing server; and the action recognition module is a vision-based action recognition module, the vision-based action recognition module recognizes the action message to generate the action recognition result, and judges whether the action recognition result is the same as or similar to the one of the one-hand dribble item, the crossover dribble item, the cross-leg dribble item and the behind-the-back dribble item of the dribble execution parameter of the scenario setting parameter group to generate the sport training result.

13. The team sports vision training method based on extended reality, voice interaction and action recognition of claim 10, wherein in the action recognizing step, the action capture device comprises:

an inertial sensor disposed on the user and sensing the action of the user to generate an inertial action message, wherein the inertial sensor transmits the inertial action message to the action recognition module of the computing server; and a vision-based sensor comprising a camera facing the user, wherein the vision-based sensor captures the action of the user via the camera to generate a vision-based action message, and transmits the vision-based action message to the action recognition module of the computing server;

wherein the action message comprises the inertial action message and the vision-based action message.

14. The team sports vision training method based on extended reality, voice interaction and action recognition of claim 13, wherein in the action recognizing step, the action recognition module comprises:

an inertial sensor-based action recognition module recognizing the inertial action message to generate an inertial action recognition result, and judging whether the inertial action recognition result is the same as or similar to the one of the one-hand dribble item, the crossover dribble item, the cross-leg dribble item and the behind-the-back dribble item of the dribble execution parameter of the scenario setting parameter group to generate a first sport training result; and a vision-based action recognition module recognizing the action message to generate the action recognition result, and judging whether the action recognition result is the same as or similar to the one of the one-hand dribble item, the crossover dribble item, the cross-leg dribble item and the behind-the-back dribble item of the dribble execution parameter of the scenario setting parameter group to generate a second sport training result;

wherein the sport training result comprises the first sport training result and the second sport training result.

15. The team sports vision training method based on extended reality, voice interaction and action recognition of claim 9, wherein, the virtual task scenario image further comprises a first color and a second color, and the first color is different from the second color; and in response to determining that the color change item is selected according to the gesture sensing result, the numbers are displayed around the virtual objects, respectively, one of the virtual objects is changed from the first color to the second color for the user to watch and then generate the speech signal, the speech recognition module judges whether the speech recognition result corresponding to the speech signal is the same as a color change number of the color change item of the scenario setting parameter group to generate the vision training result, and the color change number is equal to one of the numbers displayed around the one of the virtual objects.

16. The team sports vision training method based on extended reality, voice interaction and action recognition of claim 10, wherein the scenario setting parameter group further comprises a task difficulty adjustment parameter, and the virtual task scenario showing step further comprises:

configuring a task difficulty adjusting module of the computing server to adjust selection of the enable tactical item and the disable tactical item of the player tactical parameter, the enable defense item and the disable defense item of the defensive player generating parameter, the number add item and the color change item of the task execution parameter, and the one-hand dribble item, the crossover dribble item, the cross-leg dribble item and the behind-the-back dribble item of the dribble execution parameter according to the task difficulty adjustment parameter.

* * * * *